US007123203B2

(12) United States Patent
Le Geoff et al.

(10) Patent No.: US 7,123,203 B2
(45) Date of Patent: Oct. 17, 2006

(54) CIRCULARLY POLARIZED WIRE ANTENNA

(75) Inventors: Marc Le Geoff, Les Ulis (FR); Luc Duchesne, Angervilliers (FR); Jean-Marc Française Baracco, Vence (FR); Patrick Dumon, Vigoulet-Auzil (FR)

(73) Assignees: Centre National d'Etudes Spatiales, Paris (FR); Ste d'Applications Technologiques de l'Imagerie Micro Ondes, Les Ulis (FR)

( * ) Notice: Subject to any disclaimer, the term of this patent is extended or adjusted under 35 U.S.C. 154(b) by 0 days.

(21) Appl. No.: 10/519,200

(22) PCT Filed: Jun. 20, 2003

(86) PCT No.: PCT/FR03/01901

§ 371 (c)(1),
(2), (4) Date: Dec. 17, 2004

(87) PCT Pub. No.: WO04/001900

PCT Pub. Date: Dec. 31, 2003

(65) Prior Publication Data

US 2005/0280599 A1 Dec. 22, 2005

(30) Foreign Application Priority Data

Jun. 20, 2002 (FR) ..... 02 07625

(51) Int. Cl.
*H01Q 21/00* (2006.01)
*H01Q 1/00* (2006.01)

(52) U.S. Cl. ..... 343/725; 343/729

(58) Field of Classification Search ..... 343/724, 343/725, 729, 732, 756, 757, 769, 830
See application file for complete search history.

(56) References Cited

U.S. PATENT DOCUMENTS

| | | | | |
|---|---|---|---|---|
| 2,521,550 A | | 9/1950 | Smith | |
| 3,680,135 A | | 7/1972 | Boyer | |
| 3,942,180 A | * | 3/1976 | Rannou et al. | 343/725 |
| 4,647,937 A | * | 3/1987 | Hidaka et al. | 343/742 |
| 4,947,180 A | * | 8/1990 | Schotz | 343/743 |
| 5,264,861 A | * | 11/1993 | Roederer et al. | 343/828 |
| 5,426,439 A | | 6/1995 | Grossman | |

FOREIGN PATENT DOCUMENTS

| | | |
|---|---|---|
| EP | 0512876 | 4/1992 |
| JP | 57107610 | 7/1982 |

* cited by examiner

*Primary Examiner*—Shih-Chao Chen
*Assistant Examiner*—Minh Dieu A
(74) *Attorney, Agent, or Firm*—Blakely Sokoloff Taylor & Zafman

(57) ABSTRACT

Each of the strands being powered by a single conducting wire wherein each of these strands describes an initial segment which is radial relative to a geometric axis perpendicular to the main plane, each of the strands is extended along a circle arc center on this geometric axis and describes a substantially radial segment, directed in the direction of the geometric axis, thus running alongside radial segment directed in a direction of the geometric axis thus running alongside a radial segment of a neighbouring strand without touching the neighbouring strand.

11 Claims, 1 Drawing Sheet

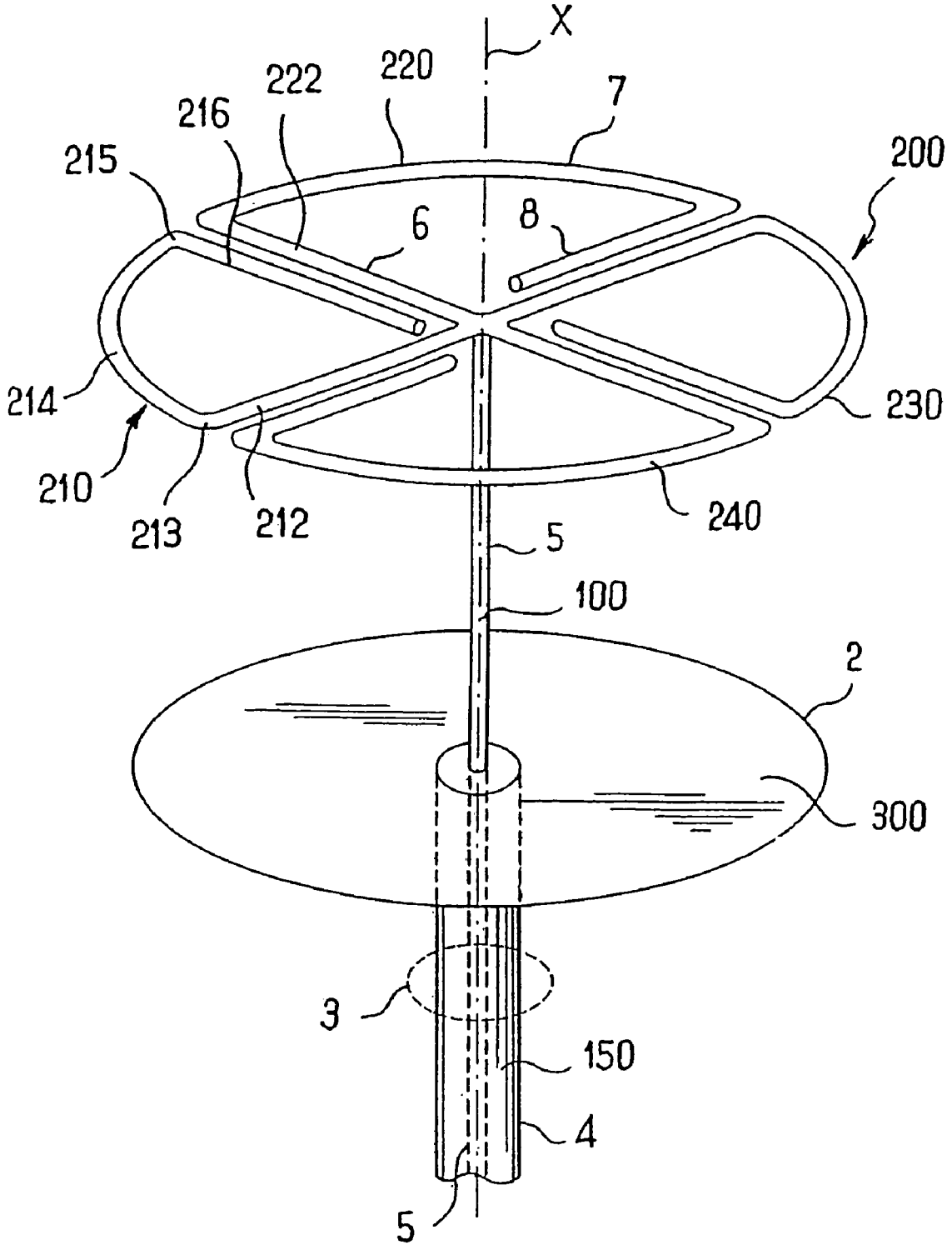
X
220
222
216
7
215
200
6
8
214
230
210
213
212
240
5
100
2
300
3
150
4
5

CIRCULARLY POLARIZED WIRE ANTENNA

The present patent application is a non-provisional application of International Application No. PCT/FR2003/001901, filed Jun. 20, 2003.

The invention relates to circularly polarised antennas, and more exactly antennas that have a revolution radiation pattern around an axis and that have a maximum radiation in the plane perpendicular to the direction of this axis.

The invention relates more specifically to patch technology antennas.

The concept of the printed antenna (or patch antenna or microstrip antenna,) appeared in 1953 with DESCHAMPS [1], and the first embodiments were produced in the 1970s by HOWELL and NUNSON [2].

Patch or printed antennas bring together all the aerials made in accordance with a technology that consists in placing a metal conducting wire above a ground plane. This metal conducting wire constitutes the radiating element of the antenna and is of reduced dimension and may be arbitrary in shape. In practice, it is often of a simple geometry such as a square, a rectangle, as disk, or a ring.

This type of antenna has the advantages of microstrips: low mass and small space requirement, planar structures that can be configured, the possibility of mass production thus allowing inexpensive production.

This technology has therefore seen wide applications in fields such as aeronautics, space technology, general public communications (mobile telephone antennas), etc Patch antenna technology is very widely disseminated in international reference works: [5], [6], [7].

The purpose of the invention is to improve existing antennas and to propose an antenna which is simple to make, and of reduced size, while providing a natural circular polarisation which is particularly clear.

This purpose is obtained according to the invention by means of an antenna made in patch technology that includes a series of strands located substantially in one and the same main plane, each of the strands being supplied with power by one of the same conducting wire, characterised in that each of the strands describes an initial segment which is radial relative to a geometric axis perpendicular to the main plane, then each of the strands is extended in a circle arc centred on this geometric axis, then again describes a substantially radial segment, directed in the direction of the geometric axis, thus running alongside a radial segment of the neighbouring strand without touching it.

Other characteristics, purposes and advantages of the invention will emerge from reading the following detailed description given with reference to the single appended FIGURE, representing in perspective, in the form of an exploded structure developed in volume for greater clarity, an antenna according to a preferred alternative of the invention.

In this figure, the antenna is constituted by three main elements, namely a rigid and rectilinear feed line 100, an array 200 of four radiating strands, and a ground plane 300. The four strands, given the reference numbers 210, 220, 230 and 240, are located in a plane perpendicular to the axis of the wire 100, and the ground plane 300 is placed parallel to the main plane of the strands. The general shape delimited by the strands and the ground plane 300 are both centred geometrically on the power wire 100.

The wire 100 therefore here defines the principal axis of symmetry X of the antenna.

Each strand 210, 220, 230, 240 is electrically connected to the wire 100. From the power wire 100 each strand presents a form similar to that of the strand 210, which will now be described. The strand 210 first of all describes an initial segment 210 which is here strictly radial and which ends at a distance from the axis X with an elbow 213, an elbow 213 which then initiates the circle arc part 214 of the strand under consideration 100.

This part or circle arc segment 214 here describes an angle of 90° around the axis, so as to end again with a right angled elbow 215. This second elbow 215 then initiates a terminal segment 216 of the strand under consideration directed towards the axis of symmetry X, stopping in proximity to the axis 100 without touching it.

Each of the strands has the same configuration, the circle arc part revolving around the axis 100 in one and the same direction (trigonometric or inverse trigonometric) for each strand. Each strand here revolves in the inverse trigonometric direction relative to the axis X.

The array of strands defines by its contour a separate circular shape in four 90° arcs. Each of the strands describes, by its two rectilinear segments and its circle arc segment, the contour of a quarter constituting the quarter of a disk.

These quarters are directly next to each other side-by-side, and since the strands all have the same inverse trigonometric direction, each radial segment which is connected to the central wire has a radial segment running alongside which is itself not connected to the power wire 100.

In this way, not only all do the four strands 210 to 240 define a general circular configuration around this geometric axis X but each of these strands additionally describes two substantially radial segments, located 90° one from the other, and each running alongside a neighbouring segment belonging to a neighbouring strand. In this way, the array of strands 210, 220, 230 and 240 forms four pairs of parallel radial segments, each considered segment of a pair belonging to a different strand. These pairs of parallel segments are present every 90° around the axis of symmetry of the antenna.

The power wire 100 is here a rectilinear wire stopping at the centre of the strands, and not extending beyond the plane of these.

This power wire 100 is constituted by the central conductor of a coaxial cable. The outer armature 150 of this coaxial cable itself stops well before the internal conductor of the coaxial cable.

The external coaxial armature 150 is in electrical connection with the ground plane 300, which forms a conducting disk of the same diameter as the circle of the strands and parallel to it. This full disk 300 is at a distance from the strands which is of the order of the diameter of the circle described by these strands.

The external armature of the coaxial cable connecting it to a potential different from that supplying power to the strands.

In this way the two conductors 100 and 150 of the coaxial cable are connected to the terminals of an electric power source, not shown here, which is located beyond the ground plane 300, opposite the strands. The ground plane 300 is therefore found between this source and the plane of the strands.

The power source not shown may be made for example with the help of a printed circuit in planar technology, a power source according to this technology being able alternatively to be placed in any part of the antenna, for example in the plane of the strands or in the ground plane 300.

The mechanical axis constituted by the power wire 100 is also the axis of symmetry of the radiation pattern. A maximum radiation is emitted on the horizon, in other words axially around the wire 100 and in the direction of the plane of the strands, while a minimum radiation is present in the direction defined by the axis of symmetry.

On a fairly wide relative frequency band (>10%), the antenna generates a natural circular polarisation. Indeed, on this frequency band, the central part of the antenna, and in particular the vertical power wire 100 of the antenna generates a component of the electromagnetic field polarised vertically having a maximum of the horizon.

The peripheral part in circle form of the antenna itself generates a component of the electromagnetic field polarised horizontally having also a maximum of the horizon.

The gain obtained with this antenna is typically 2 dB for angles of elevation between 0° and 60°.

The geometry of the antenna additionally makes it possible to obtain a phase shift of 90° between these two radiated components and one and the same amplitude for each of them.

Circular polarisation is therefore obtained with a maximum directed to the horizon. The sense of winding of the strands determines the principal polarisation. In this way the inverse trigonometric direction of winding as shown here implies a right-hand circular polarisation.

Each strand has a length of about a half wavelength at the working frequency, in other words of the order of a half wavelength at the frequency favoured for this antenna.

In order to widen the operational frequency band, additional strands may be superposed to the four initial strands. These additional strands may or may not be connected electrically to the initial strands and may or may not be of the same size as the initial strands.

A multi-frequency mode operation is also possible, either by stacking several arrays of strands as described here, preferentially along parallel superposed planes of different diameters, or by using a multiplexer connected to an array of coplanar strands.

The total thickness of the antenna proposed is small considering the wavelength (typically of about 0.04λ), which makes it compact.

The antenna shown here is very compact since its strands are folded back.

The external diameter of the circle made up of the four radiating strands is about 0.25λ, where λ is the favoured working wavelength for this antenna.

Such a small diameter makes it possible to have a reduced space requirement for the antenna from the wavelength viewpoint.

The different elements of this antenna may be made of metal.

The mass of this antenna, already small, may, through the choice of an adapted material, be even smaller.

The antenna is powered through a single wire and no additional phase-shifting circuit is necessary for its operation which makes it a simple structure to produce both from the electrical point of view and from the mechanical point of view.

This antenna and particularly the array of strands is easy to make in patch technology, in other words for example, by making the array of strands in the form of a printed circuit of a substrate film.

More generally, the antenna according to the invention is easy to make by mass production.

[1] G. A. DESCHAMPS
"Microstrip microwave antennas"
3rd USAF—Symposium on Antennas—1953

[2] J. Q. HOWELL
"Microstrip Antennas"
I.E.E.E. Transactions on Antennas and Propagation Vol. AP-22 pp 90–93-January 1975

[3] Howell, J. Q.
"Microstrip Antennas,"
IEEE AP-S Int. Symp. Digest, 1972, pp. 177–180

[4] Munson, R. E.,
"Conformal Microstrip Antennas and Microstrip Phased Arrays"
IEEE Trans. On Antennas and Propagation, Vol. AP-22, 1974, pp. 74–78.

[5] JR James & PS Hall
"Handbook of MICROSTRIP ANTENNAS" 1989

[6] IJ Bahl & P. Bhartia
"Microstrip Antennas" 1980

[7] J. R. JAMES—P. S. HALL—C. WOOD
"Microstrip antenna theory and design".

The invention claimed is:

1. Antenna made in patch technology including a series of strands (210, 220, 230, 240) located substantially in a single main plane, each of the strands being powered by a single conducting wire (100), wherein each of the strands (210, 220, 230, 240) describes an initial segment (213) which is radial relative to a geometric axis (X) perpendicular to the main plane, and each of the strands is extended along a circle arc (214) centered on this geometric axis (X), and describes a substantially radial segment (216) directed in a direction of the geometric axis (X), thus running alongside a radial segment (212) of a neighbouring strand without touching the neighbouring strand.

2. Antenna according to claim 1, wherein the conducting wire (100) of the strands (210, 220, 230, 240) is constituted by a rigid rectilinear wire (100) merged with the geometric axis (X).

3. Antenna according to claim 1, wherein each strand (210, 220, 230, 240) describes a circle arc (214) according to a direction of rotation around the axis (X), in such a way that for each strand (210, 220, 230, 240) considered, the radial segment (216) of this strand (210, 220, 230, 240) runs alongside an initial radial segment (222) of a neighbouring strand.

4. Antenna according to claim 1, wherein the series of strands (210, 220, 230, 240) describes a circular perimeter of diameter substantially equal to λ/4 where λ is a favoured working wavelength of the antenna.

5. Antenna according to claim 1, wherein the antenna also includes a conducting plane (300) parallel to the main plane including the strands (210, 220, 230, 240), which forms a ground plane of the antenna.

6. Antenna according to claim 5, wherein the conducting wire (100) is constituted by a central conductor (100) of a coaxial cable, and in that the ground plane (300) is supplied with power by an external armature (150) of this coaxial conductor.

7. Antenna according to claim 6, wherein the central conductor (100) of the coaxial cable has its end in contact with the strands (210, 220, 230, 240), and the external armature (150) of the coaxial cable has its end in contact with the ground plane (300).

8. Antenna according to claim 5, wherein the ground plane (300) forms a full disk of diameter substantially equal to the diameter of the shape described by the series of strands (210, 220, 230, 240).

9. Antenna according to claim 1, wherein the strands are four in number, each describing by their circular portion a circle arc (214) describing an angle of about 90°.

10. Antenna according to claim 1, wherein the antenna has several series of strands (210, 220, 230, 240), each series being formed by coplanar strands in a particular main plane, each of these series of strands (210, 220, 230, 240) describing a general disk shape, and these discs being superposed overlapping each other and with different diameters.

11. Antenna according to claim 1, wherein several series of strands (210, 220, 230, 240) of substantially equal or different diameter are superposed, the strands being or not being in contact with each other, in such a way that a multi-frequency mode operation is obtained.

* * * * *